US006729090B2

(12) United States Patent
Messenger et al.

(10) Patent No.: US 6,729,090 B2
(45) Date of Patent: May 4, 2004

(54) INSULATIVE BUILDING PANEL WITH TRANSVERSE FIBER REINFORCEMENT

(75) Inventors: Harold G. Messenger, Rehoboth, MA (US); Thomas G. Harmon, St. Louis, MO (US); John A. Fifield, Aylesbury (GB); John M. Carson, Greenville, SC (US)

(73) Assignee: Oldcastle Precast, Inc., Rehoboth, MA (US)

( * ) Notice: Subject to any disclaimer, the term of this patent is extended or adjusted under 35 U.S.C. 154(b) by 0 days.

(21) Appl. No.: 10/150,465

(22) Filed: May 17, 2002

(65) Prior Publication Data

US 2003/0167716 A1 Sep. 11, 2003

Related U.S. Application Data

(63) Continuation-in-part of application No. 10/093,292, filed on Mar. 6, 2002.

(51) Int. Cl.[7] ..... E04C 2/284; E04C 1/40

(52) U.S. Cl. ..... 52/309.12; 52/309.17; 52/794.1

(58) Field of Search ..... 52/309.7, 309.9, 52/309.11, 309.14, 309.16, 309.17, 407.1, 794.1

(56) References Cited

U.S. PATENT DOCUMENTS

| | | | | |
|---|---|---|---|---|
| 890,011 | A | 6/1908 | Anderson | 52/602 X |
| 1,229,904 | A | 6/1917 | Day | 52/602 X |
| 1,420,246 | A | 6/1922 | Faber | 52/602 X |
| 1,484,206 | A | 2/1924 | Birkholz | 52/602 |
| 1,834,892 | A | 12/1931 | Betzler | 52/602 X |
| 1,891,837 | A | 12/1932 | Pittman | 52/602 X |
| 1,897,327 | A | 2/1933 | Olson | 52/602 X |
| 2,080,618 | A | 5/1937 | Madsen | 52/602 X |

(List continued on next page.)

FOREIGN PATENT DOCUMENTS

| | | | |
|---|---|---|---|
| AU | 114294 | 12/1941 | 52/602 |
| EP | 16478 | 10/1980 | 52/602 |
| GB | 545526 | 6/1942 | 52/602 |
| GB | 2201175 | 8/1988 | 52/630 |

OTHER PUBLICATIONS

U.S. patent application Ser. No. 10/093,292, Messenger, filed Mar. 2002.

*Primary Examiner*—Robert Canfield
(74) *Attorney, Agent, or Firm*—SheridanRoss, P.C.

(57) ABSTRACT

An insulative panel with transverse fiber reinforcements is provided and which is adopted for use with a plurality of building materials such as concrete to create a lightweight, high strength building panel having superior insulative properties.

20 Claims, 8 Drawing Sheets

U.S. PATENT DOCUMENTS 2,312,293 A 2/1943 Weiss ..... 52/600 X
3,305,991 A * 2/1967 Weismann
3,567,816 A 3/1971 Embree ..... 52/602 X
3,597,890 A 8/1971 Hala ..... 52/309.17
3,879,908 A * 4/1975 Weismann
4,019,297 A 4/1977 Murphy ..... 52/309.2
4,073,998 A 2/1978 O'Connor ..... 428/310
4,229,497 A 10/1980 Piazza ..... 52/309.12 X
4,233,787 A 11/1980 Piazza ..... 52/602 X
4,612,748 A 9/1986 Arnold et al. ..... 52/600 X
4,617,219 A 10/1986 Shupack ..... 52/782.1 X
4,706,430 A * 11/1987 Sugita et al.
4,811,770 A * 3/1989 Rapp
4,841,702 A 6/1989 Huettemann ..... 52/309.12
4,916,004 A 4/1990 Ensminger et al. ..... 428/192
4,934,121 A 6/1990 Zimmerman ..... 52/602 X
4,990,390 A * 2/1991 Kawasaki et al.
5,032,340 A 7/1991 Akihama et al. ..... 264/258
5,058,345 A * 10/1991 Martinez ..... 52/309.11
5,095,674 A * 3/1992 Huettemann ..... 52/309.11 X
5,129,203 A * 7/1992 Romero ..... 52/309.11
5,146,721 A * 9/1992 Candiracci ..... 52/309.11 X
5,317,848 A 6/1994 Abbey ..... 52/630 X
5,493,836 A 2/1996 Lopez-Munoz ..... 52/602
5,493,838 A 2/1996 Ross ..... 52/745.1
5,758,463 A 6/1998 Mancini, Jr. ..... 52/309.12
5,836,715 A 11/1998 Hendrix et al. ..... 404/134
D406,902 S 3/1999 Lockwood ..... D25/1
5,894,003 A 4/1999 Lockwood ..... 264/36.19
D426,321 S 6/2000 Lockwood ..... D25/138
6,088,985 A 7/2000 Clark ..... 52/309.11
6,094,881 A 8/2000 Lockwood ..... 52/731.2
6,164,035 A 12/2000 Roberts ..... 52/563
6,202,375 B1 3/2001 Kleinschmidt ..... 52/309.11
6,230,465 B1 5/2001 Messenger et al. ..... 52/630
2002/0189182 A1 * 12/2002 record

* cited by examiner

INSULATIVE BUILDING PANEL WITH TRANSVERSE FIBER REINFORCEMENT

This application is a continuation-in-part of pending U.S. patent application Ser. No. 10/093,292, filed Mar. 6, 2002, and is incorporated herein in its entirety by reference.

FIELD OF THE INVENTION

The present invention relates to building components, and more specifically composite lightweight building panels which can be interconnected to build structures such as modular buildings or applied as cladding to building frames.

BACKGROUND OF THE INVENTION

Due to the high cost of traditional concrete components and the extensive transportation and labor costs associated therein, there is a significant need in the construction industry to provide a lightweight, precast, composite building panel which may be transported to a building site and assembled to provide a structure with superior strength and insulative properties. Previous attempts to provide these types of materials have failed due to the extensive transportation costs, low insulative values and thermal conductivity associated with prefabricated concrete wire reinforced products. Further, due to the brittle nature of concrete, many of these types of building panels become cracked and damaged during transportation.

More specifically, the relatively large weight per square foot of previous building panels has resulted in high expenses arising not only from the amount of materials needed for fabrication, but also the cost of transporting and erecting the modules. Module weight also placed effective limits on the height of structures, such as stacked modules, e.g. due to limitations on the total weight carried by the foundations, footings and lowermost modules. Furthermore, there is substantial fabrication labor expense that can arise from efforts needed to design reinforcement, and the materials and labor costs involved in providing and placing reinforcement materials. Accordingly, it would be useful to provide a system for modular construction which is relatively light, can be readily stacked to heights greater than in previous configurations and, preferably, inexpensive to design and manufacture.

Further, in many situations panels or modules are situated in locations where it is desirable to have openings therethrough to accommodate doorways, windows, cables, pipes and the like. In some previous approaches, panels were required to be specially designed and cast so as to include any necessary openings, requiring careful planning and design and increasing costs due to the special, non-standard configuration of such panels. In other approaches, panels were cast without such openings and the openings were formed after casting, e.g. by sawing or similar procedures. Such post-casting procedures as cutting, particularly through the thick and/or steel-reinforced panels as described above, is a relatively labor-intensive and expensive process. In many processes for creating openings, there was a relatively high potential for cracking or splitting of a panel or module. Accordingly, it would be useful to provide panels and modules which can be post-fitted with openings such as doors and windows in desired locations and with a reduced potential for cracking or splitting.

One further problem associated with metallic wire materials used in conjunction with concrete is the varying rates of expansion and contraction. Thus with extreme heating and cooling the metallic wire tends to separate from the concrete, thus creating cracks, exposure to moisture and the eventual degradation of both the concrete and wire reinforcement.

One example of a composite building panel which attempts to resolve these problems with modular panel construction is described in U.S. Pat. No. 6,202,375 to Kleinschmidt (the '375 patent). In this invention, a building system is provided which utilizes an insulative core with an interior and exterior sheet of concrete and which is held together with a metallic wire mesh positioned on both sides of an insulative core. The wire mesh is embedded in concrete, and held together by a plurality of metallic wires extending through said insulative core at a right angle to the longitudinal plane of the insulative core and concrete panels. Although providing an advantage over homogenous concrete panels, the composite panel disclosed in the '375 patent does not provide the necessary strength and flexure properties required during transportation and high wind applications. Further, the metallic wire mesh materials are susceptible to corrosion when exposed to water during fabrication, and have poor insulative qualities due to the high heat transfer qualities of metallic wire. Thus, the panels disclosed in the '375 patent may eventually fail when various stresses are applied to the building panel during transportation, assembly or subsequent use. Furthermore, these panels have poor insulative qualities in cold climates due to the high heat transfer associated with the metallic wires.

Other attempts have been made to use improved building materials that incorporate carbon fiber. One example is described in U.S. Pat. No. 6,230,465 to Messenger, et al. which utilizes carbon fiber in combination with a steel reinforced precast frame with concrete. Unfortunately, the insulative properties are relatively poor due to the physical nature of the concrete and steel, as well as the excessive weight and inherent problems associated with transportation, stacking, etc.

Accordingly, there is a significant need in the construction and building industry to provide a composite building panel which may be used in modular construction and which is lightweight, provides superior strength and has high insulative values. Further, a method of making these types of building panels is needed which is inexpensive, utilizes commonly known manufacturing equipment, and which can be used to mass produce building panels for use in the modular construction of warehouses, low cost permanent housing, hotels, and other buildings.

SUMMARY OF THE INVENTION

It is thus one aspect of the present invention to provide a composite wall panel which has superior strength, high insulating properties, is lightweight for transportation and stacking purposes and is cost effective to manufacture. Thus, in one embodiment of the present invention, a substantially planar insulative core with interior and exterior surfaces is positioned between concrete panels which are reinforced with carbon fiber grids positioned substantially adjacent the insulative core and which is interconnected to a plurality of diagonal carbon fiber strands. In a preferred embodiment of the present invention, the interior layer of concrete is comprised of a low-density concrete.

It is yet another aspect of the present invention to provide a superior strength composite wall panel which utilizes carbon fiber materials which are oriented in a novel geometric configuration which interconnects the insulative core and both the interior and exterior concrete panels. In one embodiment of the present invention, a plurality of carbon fibers are oriented in a substantially diagonal orientation through the insulative core and which may be operably interconnected to carbon fiber mesh grids positioned proximate to the interior and exterior surfaces of the insulative core and which operably interconnect both the interior and exterior concrete panels to the insulative core. Preferably, the carbon fiber mesh grid is comprised of a plurality of first carbon fiber strands extending in a first direction which are operably interconnected to a plurality of second carbon fiber strands oriented in a second direction. Preferably, the carbon fiber mesh grids are embedded within the interior and exterior concrete panels.

It is a further aspect of the present invention to provide a composite wall panel with an insulative core which has superior compressive strength and which utilizes STYROFOAM®, a ridged, light-weight expanded polystyrene ("EPS") material, or other similar materials. Thus, in another aspect of the present invention, a plurality of anti-compression pins are placed throughout the insulative core and which extend substantially between the interior and exterior surfaces of the insulative core. Preferably, these pins are comprised of ceramic, fiberglass, carbon-fiber or other materials which are resistant to compression and do not readily transfer heat.

It is another aspect of the present invention to provide a composite wall panel which can be easily modified to accept any number of exterior textures, surfaces or cladding materials for use in a plurality of applications. Thus, the present invention is capable of being finished with a brick surface, stucco, siding and any other type of exterior surface. In one embodiment of the present invention, a paraffin protective covering is provided on the exterior surface for protection of the exterior surface during manufacturing. The paraffin additionally prevents an excessive bond between the individual bricks and exterior concrete wall to allow the removal of a cracked or damaged brick and additionally has been found to reduce cracking in the bricks due to the differential shrinkage of the exterior concrete layer and clay brick. Furthermore, other types of materials such as drywall and other interior finishes can be applied to the interior concrete panel as necessary for any given application.

It is yet a further aspect of the present invention to provide a novel brick configuration which allows broken or cracked bricks to be quickly and effectively replaced. Thus, in one embodiment of the present invention a beveled brick design is provided wherein a rear portion of the brick has a greater diameter than a front end, and is embedded into the exterior concrete layer during the forming process. This design provides superior strength, and allows a damaged brick to be chiseled free and quickly replaced with a new brick by applying a glue or epoxy material.

It is yet another aspect of the present invention to provide a composite modular wall panel which can be used to quickly and efficiently construct modular buildings and temporary shelters and is designed to be completely functional with regard to electrical wiring and other utilities such as telephone lines, etc. Thus, the present invention in one embodiment includes at least one utility line which may be positioned at least partially within the composite wall panel and which accepts substantially any type of utility line which may be required in residential or commercial construction, and which can be quickly interconnected to exterior service lines. This utility line may be oriented in one or more directions and positioned either near the interior concrete panel, exterior concrete panel, or both.

It is yet another aspect of the present invention to provide a novel surface configuration of the insulative core which assures a preferred spacing between the surface of the insulative core and the carbon fiber grid. This surface configuration is applicable for a front surface, a rear surface, or both depending on the application. More specifically, the spacing is designed to provide a gap between the interior and/or the exterior surface of the insulative core and the carbon fiber grids to assure that concrete or other facing materials become positioned between the surface of the insulative core and the carbon fiber grid. This improved and consistent spacing enhances the strength and durability of the insulative panel when interconnected to the facing material, carbon fiber grids and transverse fibers and/or steel prestressing strands.

Thus, in one embodiment of the present invention the insulative core may have an interior and/or an exterior surface which is undulating, i.e., wavy, and alternative embodiments may have channels or protruding rails, spacer "buttons", a "waffleboard" configuration, or other shapes which create a preferred spacing between the surface of the insulative material and the fiber grids. Preferably, the spacing apparatus, channels, rails or other spacers are integrally molded with the insulative core to reduce labor and expenses. Alternatively, these spacing apparatus may be interconnected to the insulative foam after manufacturing, and may be attached with adhesives, screws, nails, staples or other interconnection means well known by one skilled in the art.

Thus, in one embodiment of the present invention, a reinforced insulative core which adapted for use with at least one facing material is provided, and which comprises:

- an insulative material having a front surface, a back surface, a top side, a bottom side and a pair of opposing lateral edges extending there between;
- a first plurality of fibers positioned proximate to said front surface and extending substantially between said top side, said bottom side and said pair of opposing lateral edges;
- a second plurality of fibers positioned proximate to said back surface and extending substantially between said top side, said bottom side and said pair of opposing lateral edges;
- at least one interwoven fiber grid extending from said back surface to said front surface of said substantially insulative planar material, and interconnecting said first plurality of fibers to said second plurality of fibers; wherein said substantially planar insulative material, said interwoven fiber grid and said first and said second plurality of fibers are operatively interconnected; and
- a plurality of protuberances extending outwardly from said front surface and said back surface of said insulative material, wherein a space is provided between said first and said second plurality of fibers, respectively, and said front surface and said back surface.

DETAILED DESCRIPTION

Figure 1:
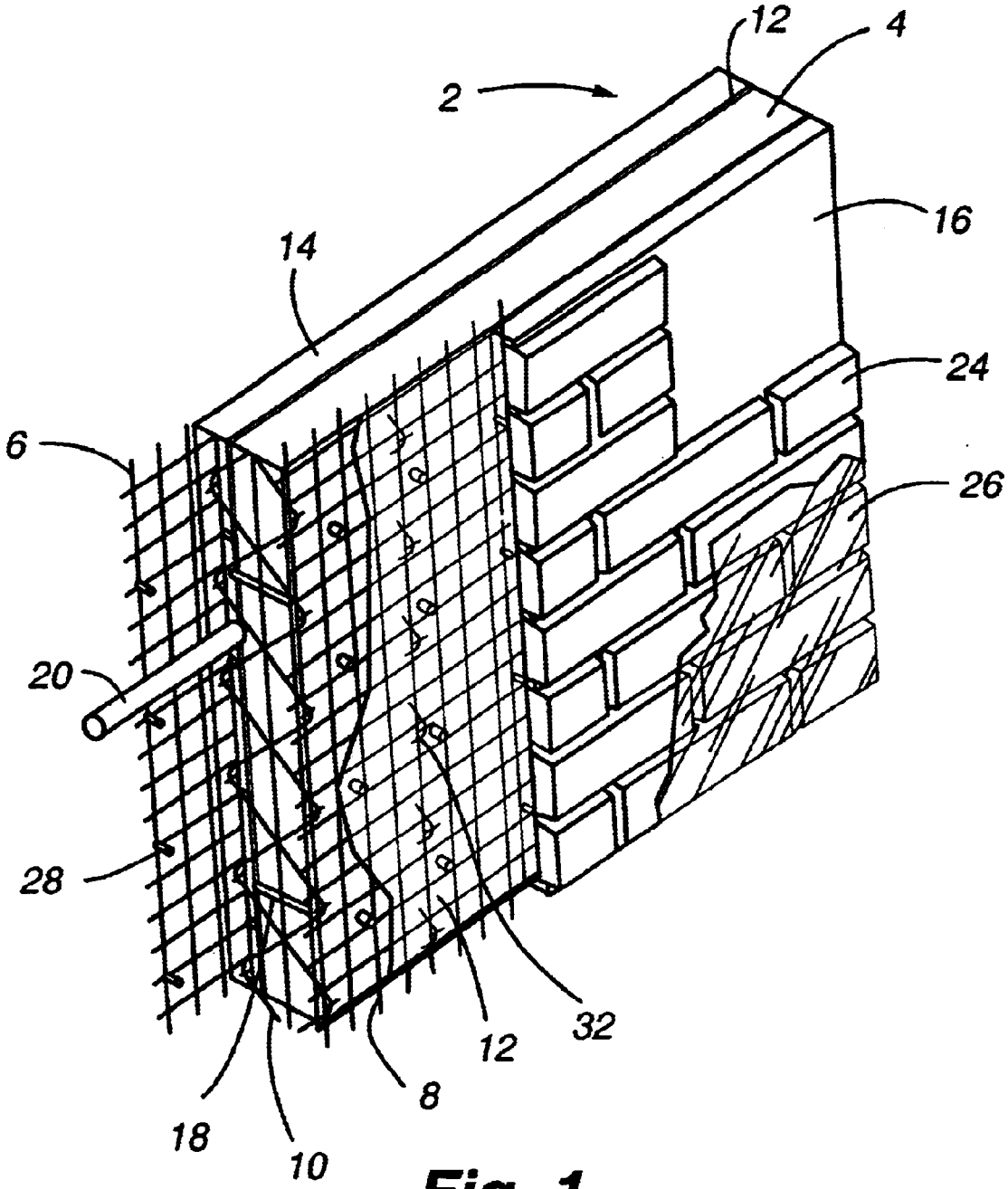
FIG. 1 is a front perspective view of a composite building panel which represents one embodiment of the present invention.

Referring now to the drawings, FIG. 1 is a front perspective view of one embodiment of the present invention and which generally identifies a novel composite building panel 2. The building panel 2 is generally comprised of an insulative core 4 which has an interior and exterior surface and a substantially longitudinal plane extending from a lower portion to an upper portion of said insulative core 4. The interior surface of the insulative core 4 is positioned immediately adjacent an interior concrete layer 14, while the exterior layer of the insulative core 4 is positioned substantially adjacent an exterior concrete layer 16. An interior carbon fiber grid 6 and an exterior carbon fiber grid 8 are additionally positioned substantially adjacent the interior and exterior surfaces of the insulative core 4, respectively, and which are preferably embedded within the interior concrete layer 14 and the exterior concrete layer 16. These carbon fiber grids are connected to a plurality of carbon fiber strands 10 which are oriented in a substantially diagonal configuration with respect to the longitudinal plane of the insulative core 4. The plurality of carbon fiber strands extend from the exterior concrete carbon fiber grid 8 through the insulative core 4 and are interconnected to the interior carbon fiber grid 6 on the opposing side. To assure proper spacing of the interior carbon fiber grid 6 and exterior carbon fiber grid 8, a plurality of spacers 28 may be employed in one embodiment of the present invention. Additionally, plastic or metallic connector clips 32 are preferably used to interconnect the carbon fiber strands 10 to the interior carbon fiber grid 6 and exterior carbon fiber grid 8.

As further identified in FIG. 1, in one embodiment of the present invention a utility conduit 20 is provided which is at least partially embedded in the insulative core 4 while partially embedded in the interior concrete layer 14 and which is used to contain electrical wiring, cabling, telephone wiring, and other types of utility lines commonly used in the construction of interior walls and building panels. The conduit is preferably comprised of a PVC plastic based on the cost, flexibility and low heat transfer properties, but as appreciated by one skilled in the art may also be a clad metal, fiberglass, or other materials. Furthermore, the utility conduit 20 may be positioned in the center of the insulative core 4, within the exterior concrete layer 16 or interior concrete layer 14, or may be oriented in a vertical as well as horizontal direction.

As additionally seen in FIG. 1, an exterior cladding material 22 is provided which in this particular example comprises a plurality of bricks 24. Alternatively, stucco, vinyl or wood siding may additionally be used as well as other materials commonly known in the construction industry. Additionally, when a plurality of bricks 24 are employed, a paraffin protective coating material 26 may be applied on the exterior surface of the bricks 24 prior to placement and casting. Upon completion of casting of the modular panel, the paraffin coating 26 or other protective coating may be removed by hot steam to provide a clean surface.

In another embodiment of the present invention, a plurality of compression pins 18 may be positioned throughout the insulative core 4 to provide additional compressive strength to the composite panel 2. Thus, as identified in FIGS. 1 and 2, the compression pins 18 are generally positioned at right angles to the longitudinal plane of the substantially planar insulative core 4, and may be comprised of ceramic, fiberglass, carbon fiber or other materials which are resistant to compression and have low heat transfer properties and are not susceptible to corrosion and rust when exposed to water. In one embodiment, the compression pins are comprised of a plastic PVC material having a length based on the thickness of the insulative core 4, and which is generally between about 1.5 inches and 3 inches and a diameter of between about 0.25 inches to 1 inch.

Figure 2:
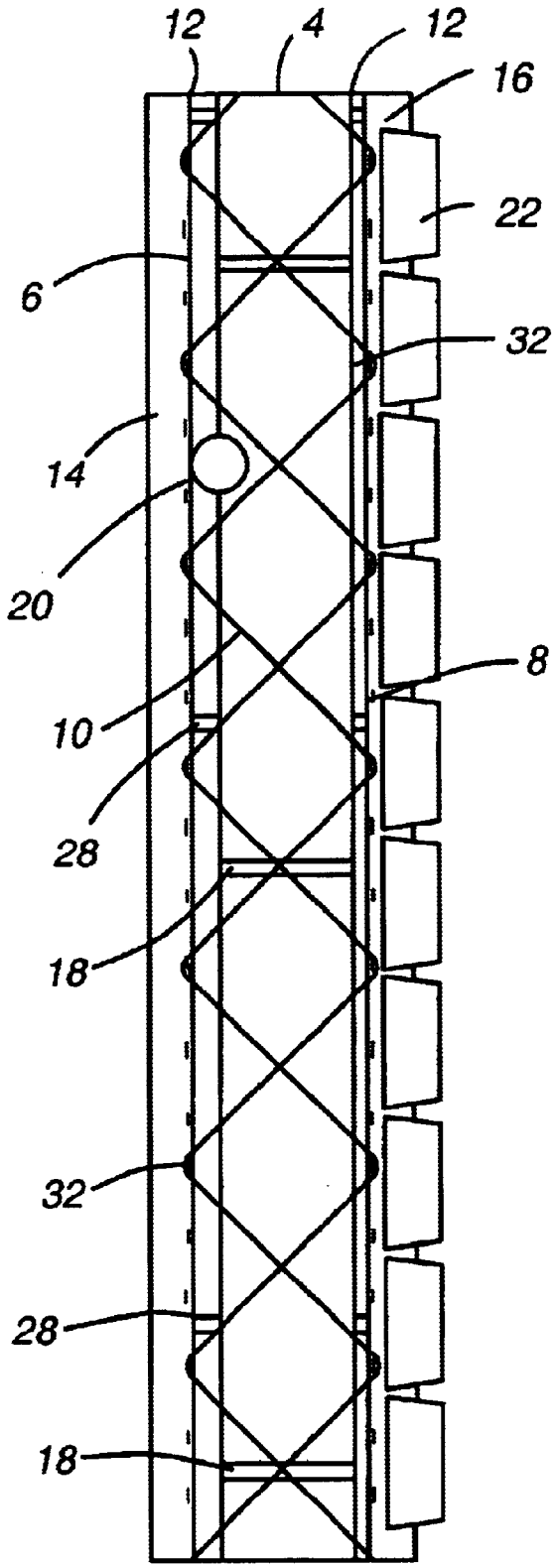
FIG. 2 is a left elevation view of the embodiment shown in FIG. 1.

Referring now to FIG. 2, a left elevation end view is provided of the panel shown in FIG. 1, and which provides additional detail regarding the various components utilized in the composite wall panel 2. As depicted, the central portion of the composite wall panel 2 comprises an insulative core 4. This insulative core 4 is generally comprised of an expanded polystyrene such as STYROFOAM® or other similar lightweight material and has a width of between about 1 to 4 inches, and more preferably about 2.5 inches. As appreciated by one skilled in the art, the thickness of the insulative core 4 is dependent upon the specifications of the building structure and the application for use, including outside air temperature, building height, anticipated wind forces, etc. Further, a vapor barrier 12 may be applied to an interior or exterior surface of the insulative core 4 to substantially prevent any moisture from penetrating the composite wall panel 2.

In one embodiment of the present invention, the insulative core 4 is manufactured in a unique process with a plurality of carbon fibers strands 10 positioned in a ribbon/tape pattern 30 which extends through the insulative core 4 and which protrudes beyond both the interior and exterior surfaces to accommodate interconnection to the interior and exterior carbon fiber grids. Alternatively, metallic materials such as wire and mesh comprised of steel or other similar materials may also be used as appreciated by one skilled in the art.

Figure 4:
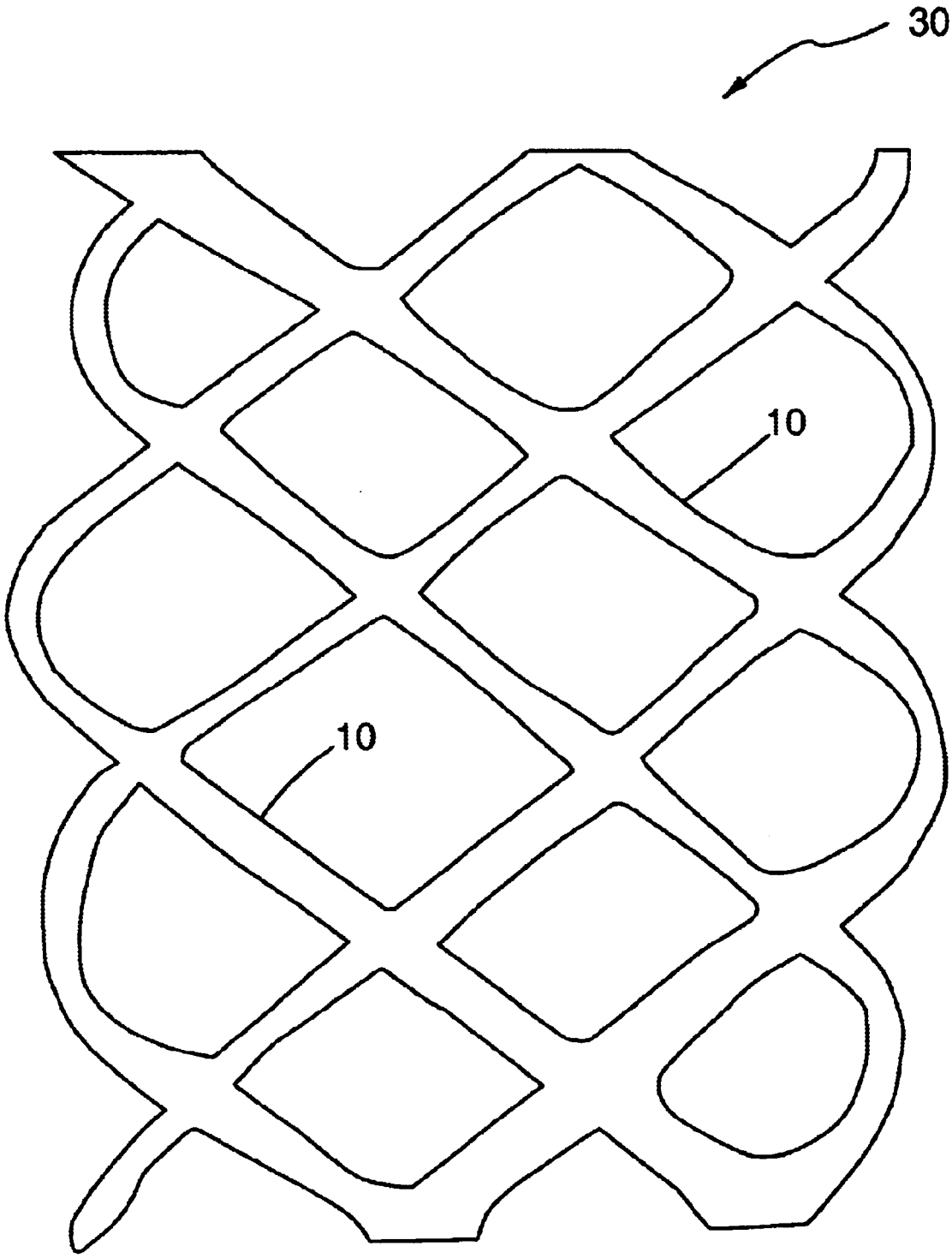
FIG. 4 is a top plan view of one embodiment of a carbon fiber tape which is positioned within an insulative core of the composite building panel of the present invention.

A depiction of one embodiment of the carbon fiber strands 10 and their orientation and interconnection may be seen in FIG. 4. These carbon fiber strands 10 generally have a thickness of between about 0.05 inches to 0.4 inch, and more preferably a diameter of about 0.15 inches. As more typically referred to in the art, the carbon fiber strands 10 have a given "tow" size. The tow is the number of carbon strands, and may be in the example between about 12,000–48,000 individual strands, i.e., 12K to 48K tow. The intersection points of the carbon fiber strands which are required to make the tape pattern are interconnected with a strong resin such as a thermoset which si applied under a predetermined heat and pressure. In another embodiment, the individual strands of carbon fiber may be "woven" with other strands to create a stronger ribbon/tape material 30.

As shown in FIG. 2, the carbon fiber strands 10 are interconnected to the interior carbon fiber grid 6 positioned substantially adjacent to the interior surface of the insulative core and with the exterior carbon fiber grid 8 positioned substantially adjacent the exterior surface of the insulative core 4. One example of a carbon fiber grid ribbon 30 which may be used in the present invention is the "MeC-GRID™" carbon fiber material which is manufactured by Hexcel Clark-Schwebel. The interior and exterior carbon grid tape is comprised generally of looped or crossed weft and warped strands, that run substantially perpendicular to each other and are machine placed on several main tape "stabilizing strands" that run parallel to the running/rolling direction of the tape. The carbon fiber tape is then used in a totally separate process by casting it transversely through the insulating core 4, to produce an insulated structural core panel that links together compositively the interior concrete layer 14 and exterior concrete layer 16 of the composite wall panel 2.

After manufacturing, the insulative core 4 can be interconnected to the interior carbon fiber grid 6 and exterior carbon fiber grid 8 and the utility conduit 20 is placed in position along with any of the compression pins 18, and other spacers 28, to assure the proper positioning of the wall panel components prior to pouring the interior concrete layer 14 or exterior concrete layer 16. The insulative core 4 is then positioned in a form, wherein the interior concrete layer 14 is poured as well as the exterior concrete layer 16 as necessary. Once the interior and exterior concrete layers are cured and set, the composite wall panel 2 is removed from the form and is subsequently ready for transportation. Alternatively exterior cladding materials 22 such as bricks or form liners may be positioned prior to pouring the exterior concrete layer 16 to allow the bricks 24 to be integrally interconnected to the concrete.

Figure 3:
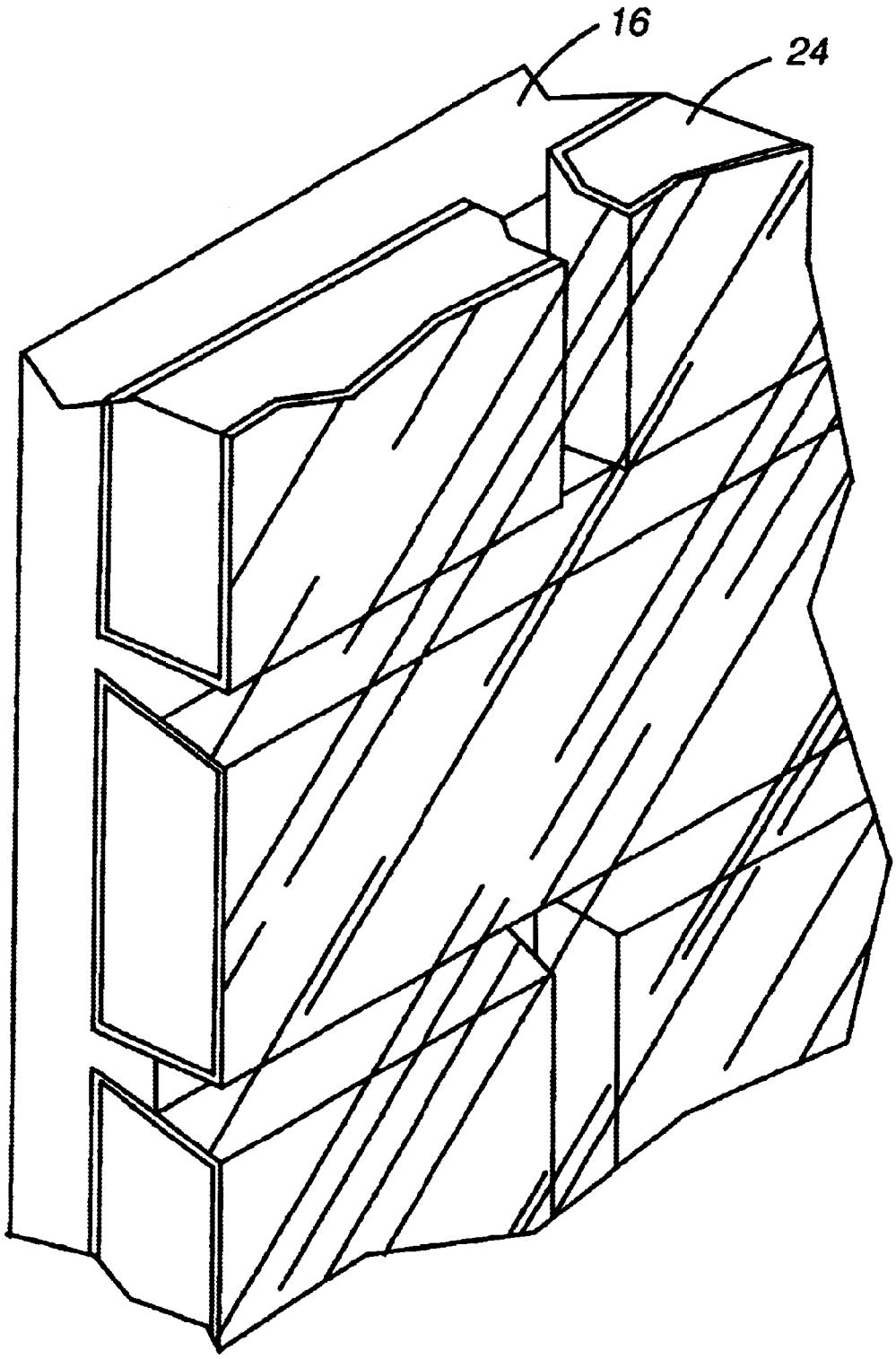
FIG. 3 is a front perspective view identifying an outer concrete layer and a novel brick cladding material embedded therein.

Referring now to FIG. 3, a front perspective view of one embodiment of the present invention is shown herein, wherein an exterior cladding material 22 of brick 24 is shown embedded in the exterior concrete layer 16. In this particular embodiment the plurality of bricks 24 are embedded into the exterior concrete layer 16 to provide a finished look and which may include a variety of other materials such as stucco, vinyl siding, and others as previously discussed. In a preferred embodiment, the outermost optional cladding layer is placed on the casting form face down during the manufacturing process and which may additionally be made of tile, brick slips, exposed aggregate or a multitude of other exterior finish components as is required. The exterior cladding 22 typically adds ¼ to ⅝ inch to the overall wall thickness and must be able to withstand moisture and water penetration, ultraviolet and sunlight exposure, and a full range of potentially extreme surface temperature changes as well as physical abuse, all without the danger of deterioration or delamination of the exterior cladding material 22 from the exterior concrete layer 16.

In a preferred embodiment of the present invention, the bricks 24 are provided with a rear end having a greater diameter than a forward end, and thus creating a trapezoidal type profile as shown in FIGS. 2 and 3. By utilizing this shape of brick 24, the bricks are integrally secured to the exterior concrete layer 16. Further, if one or more bricks become damaged or chipped during manufacturing or transportation, they may be chiseled out and a replacement brick glued in its place with an epoxy or other type of glue commonly known in the art.

With regard to the concrete utilized in various embodiments of the present application, the interior wall may be comprised of a low density concrete such as Cret-o-Lite™, which is manufactured by Advanced Materials Company of Hamburg, N.Y. This is an air dried cellular concrete which is nailable, drillable, screwable, sawable and very fire resistant. In a preferred embodiment, the exterior concrete layer 16 is comprised of a dense concrete material to resist moisture penetration and in one embodiment is created using VISCO CRETE™ or equal product which is a chemical that enables the high slumped short pot life liquification of concrete to enable the concrete to be placed in narrow wall cavities with minimum vibration and thus create a high density substantially impermeable concrete layer. VISCO-CRETE™ is manufactured by the Sika Corporation, located in Lyndhurst, N.J. The exterior concrete layer 16 is preferably about ¾ to 2 inches thick, and more preferably about 1.25 inches thick. This concrete layer has a compression strength of approximately 5000 psi after 28 days of curing, and is thus extremely weather resistant.

In a preferred embodiment of the present invention, a vapor barrier material 12 may be positioned next to or on to the exterior surface of the insulative core 4, or alternatively on the interior surface of the insulative foam core 4. The vapor barrier 12 impedes the penetration of moisture and thus protects the foam core from harsh environmental conditions caused by temperature changes. Preferably, the vapor barrier 12 is comprised of a plastic sheet material, or other substantially impermeable materials that may be applied to the insulative core 4 during manufacturing of the foam core, or alternatively applied after manufacturing and prior to the pouring of the exterior concrete layer 16.

Figure 5:
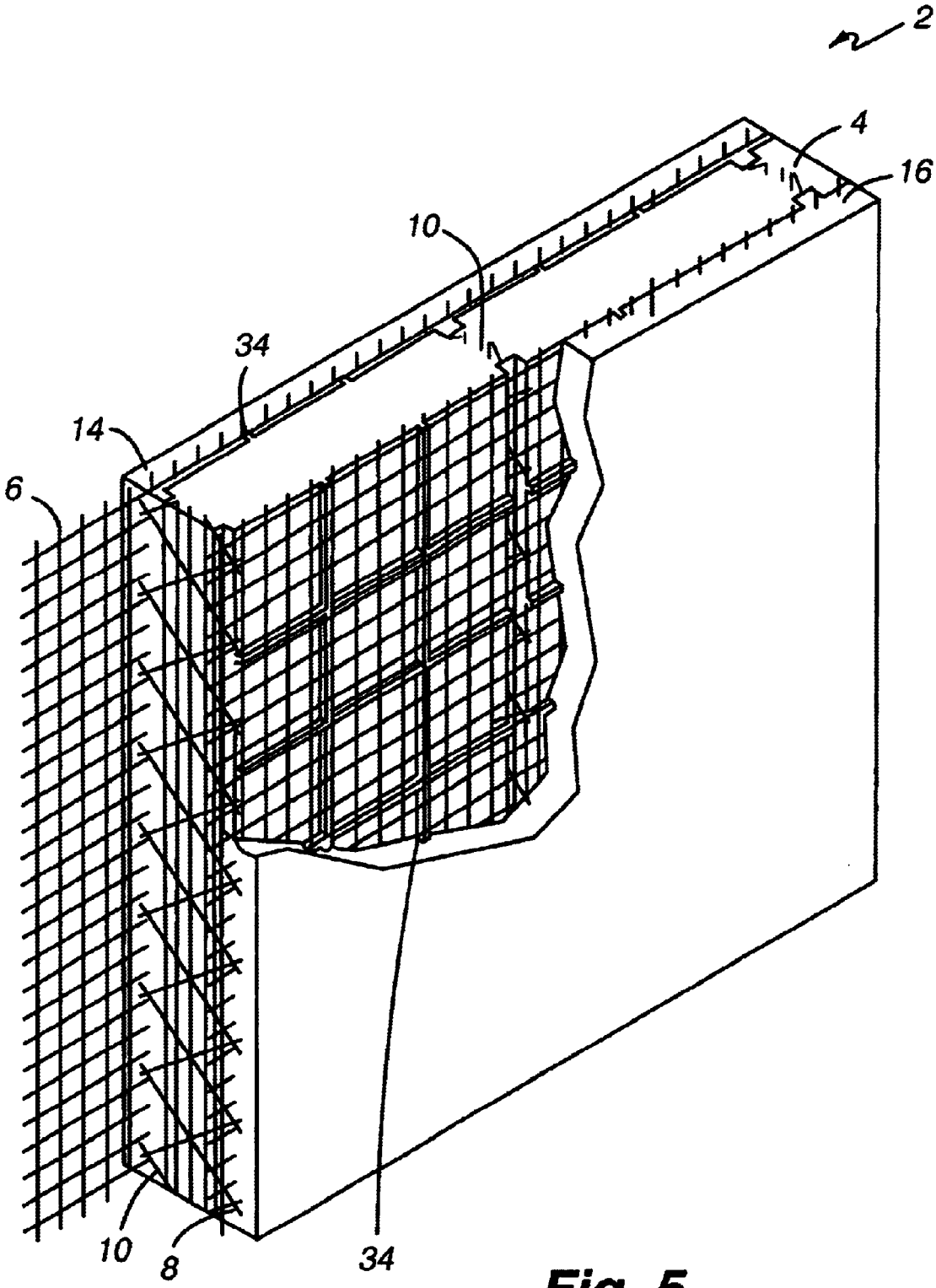
FIG. 5 is a front perspective view of an alternative embodiment of the composite building panel of the present invention, wherein the insulative core has a waffleboard design.

Referring now to FIG. 5, an alternative embodiment of the present invention is provided herein, wherein the insulative core 4 has an exterior surface and an interior surface with a specific geometric profile to provide sufficient spacing between the adjacent carbon fiber grids. More specifically, in this embodiment the insulative core 4 has a "waffleboard" profile which comprises a plurality of vertical and horizontally oriented rails which provide spacing between the surface of the insulative core 4, and the interior carbon fiber grid 6 or exterior carbon fiber grid 8. In a preferred embodiment the protruding rails extend outwardly about ¼ inch, but may vary between ⅛ and 1.5 inches depending on the application. In the embodiment shown in FIG. 5, the extruding rails are positioned on both an exterior surface of the insulative core 4 and in interior surface. As appreciated by one skilled in the art, depending on the application the spacing means may be provided on an exterior surface, an interior surface or both.

Figure 6:
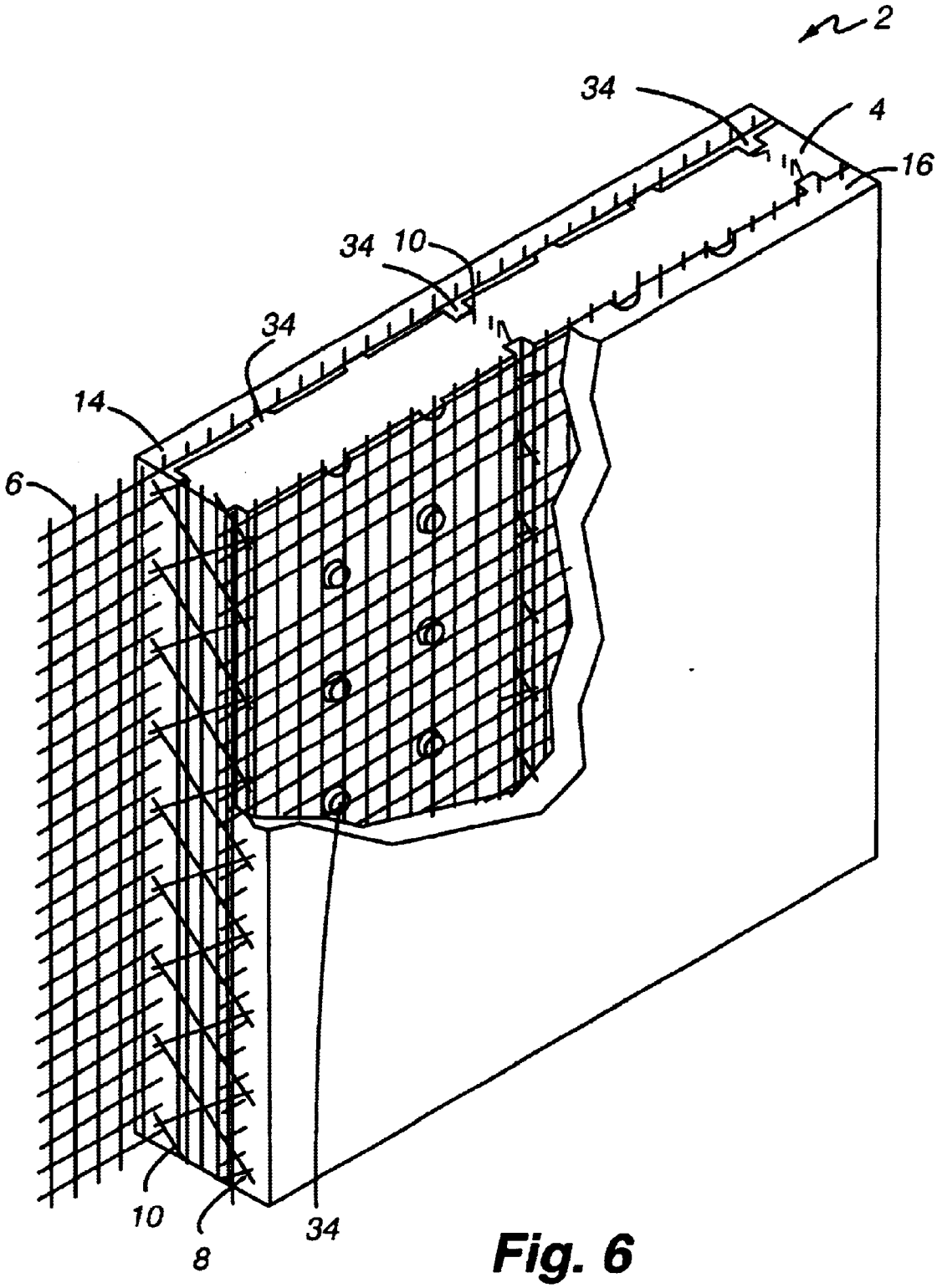
FIG. 6 is a front perspective view of an alternative embodiment of the composite building panel of the present invention, where the insulative core comprises a plurality of spacing members.

Referring now FIG. 6, an alternative embodiment of the present invention is provided herein, wherein spacing between the insulative core 4 and carbon fiber grids are provided with a plurality of "buttons" 34 or other types of protuberances which selectively raise the interior and exterior carbon fiber grids a preferred distance with respect to the interior and exterior surface of the insulative core 4. In this particular embodiment, the spacing buttons 34 are positioned at approximately four inch intervals, in both a horizontal and vertical direction, but as appreciated by one skilled the art may have any variety of spacing configurations between about 2 inches and 2 feet. Furthermore, the spacing buttons 34, rails or protuberances provided in FIG. 6 are preferably integrally molded with the insulative core 4 during manufacturing, although this type of spacing apparatus 34 may be selectively interconnected after manufacturing by means of adhesives, nails, screws, or other apparatus commonly known in the art.

Figure 7:
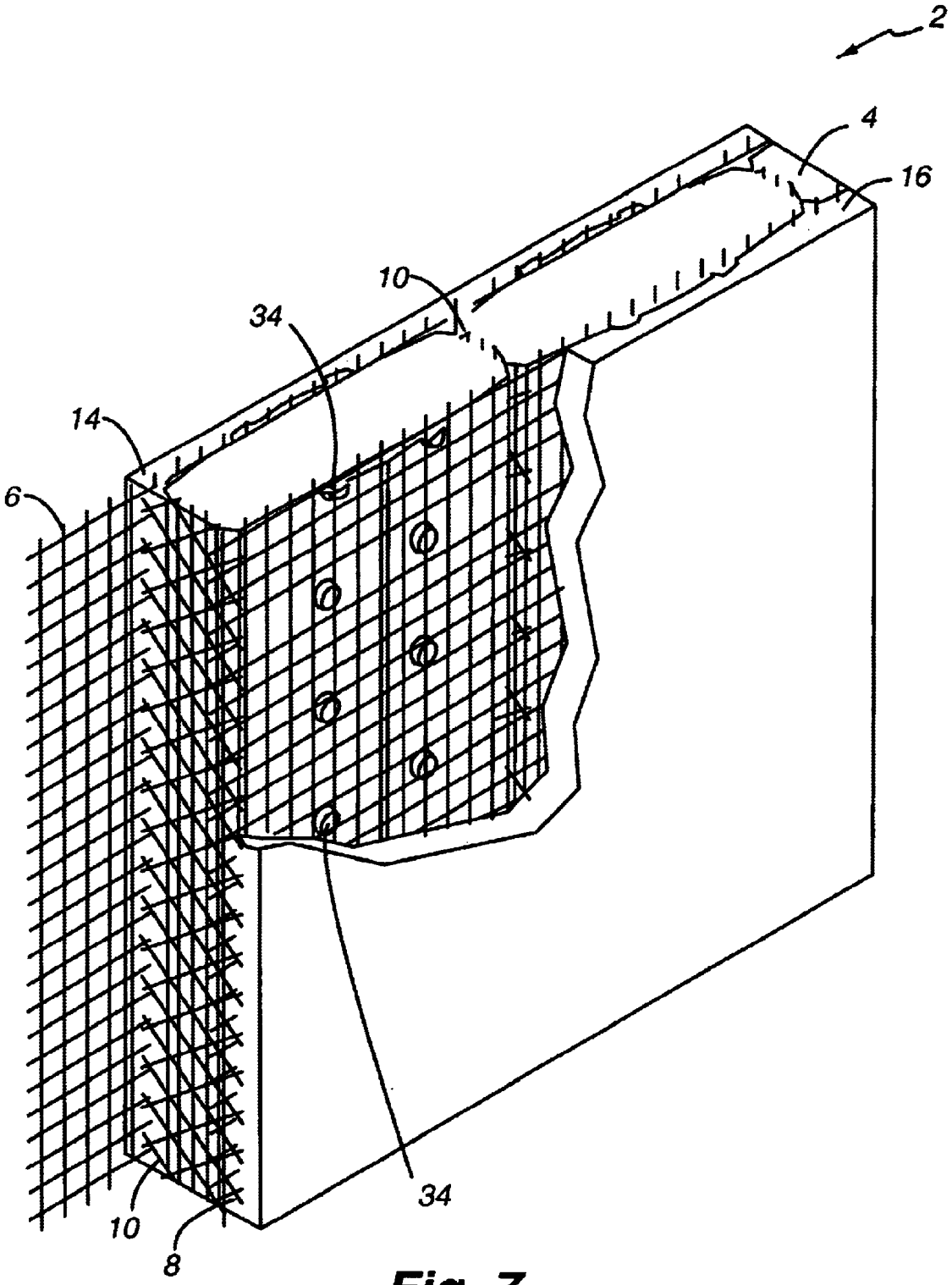
FIG. 7 is a front perspective view of an alternative embodiment of the invention shown in FIG. 6, wherein the insulative core has a tapered geometric profile.

Referring now to FIG. 7, an alternative embodiment of the invention shown in FIG. 6 is provided herein. More specifically, the insulative core 4 of FIG. 7 has a tapered geometric profile as viewed from a top plan view, wherein the transversely oriented carbon fiber strands 10 penetrate through the insulative core 4 at a location with a reduced thickness. This tapered profile repeats itself in between each of the transversely oriented carbon fiber ribbon/tape strands 10 to provide a somewhat arcuate or tapered shape. Preferably, the distance between the widest and narrowest portion of the insulative core 4 has a difference in width of between about 0.25 and 1.5 inches, and more preferably about ⅜ of inch.

Figure 8:
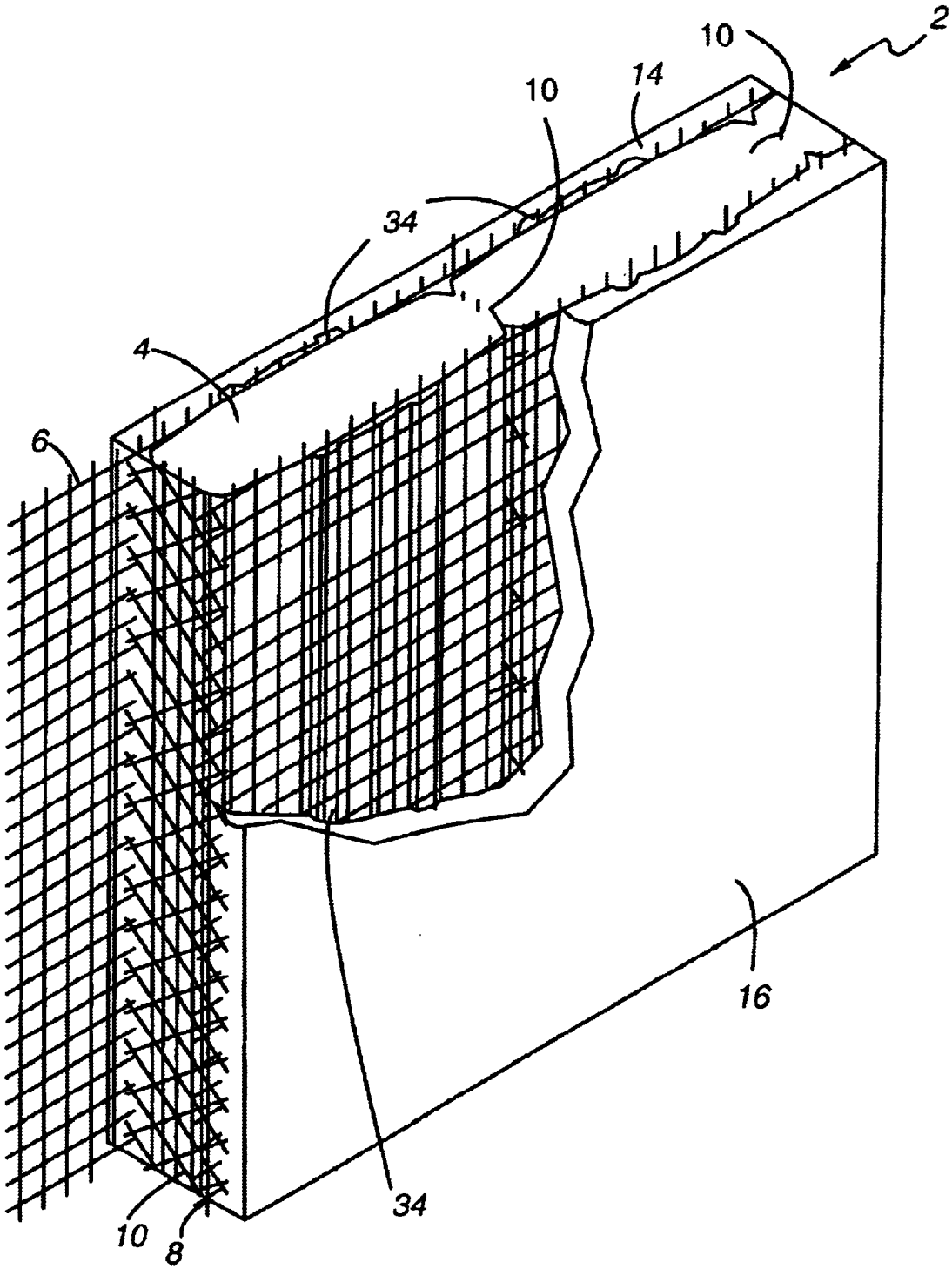
FIG. 8 is a front perspective view of an alternative embodiment of the composite building panel of the present invention wherein the insulative core has vertically oriented protruding strips as spacing members.

Referring now to FIG. 8, an alternative embodiment of the present invention is provided herein, wherein the insulative core 4 has a tapered, arcuate shaped profile, and further includes a plurality of spacing rails 34 oriented in a substantially vertical direction and with a preferred spacing. Thus, the width of the insulative core 4 is greatest at the location of the spacing rails 34, and is at a minimum at the positioning of the transverse oriented carbon fiber strands 10. As appreciated by one skilled in the art, the spacing apparatus may have any possible shape or dimension, as long as space is provided between the front surface or back surface of the insulative core, respectively and the interior and exterior grids to allow room for a cladding material such as concrete.

To assist in the understanding of the present invention, the following is a list of the components identified in the drawings and the numbering associated therewith:

| # | Component |
|---|---|
| 2 | Composite building panel |
| 4 | Insulative core |
| 6 | Interior carbon fiber grid |
| 8 | Exterior carbon fiber grid |
| 10 | Carbon fiber strands |
| 12 | Vapor barrier |
| 14 | Interior concrete layer |
| 16 | Exterior concrete layer |
| 18 | Compression pins |
| 20 | Utility conduit |
| 22 | Exterior cladding |
| 24 | Bricks |
| 26 | Paraffin Coating |
| 28 | Spacers |
| 30 | Carbon fiber ribbon/tape |
| 32 | Connector clip |
| 34 | Spacing buttons, rails, or channels |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A reinforced insulative core adapted for use with at least one facing material, comprising:

an insulative material having a front surface, a back surface, a top side, a bottom side and a pair of opposing lateral edges extending therebetween;

a first plurality of fibers positioned proximate to said front surface and extending substantially between said top side, said bottom side and said pair of opposing lateral edges;

a second plurality of fibers positioned proximate to said back surface and extending substantially between said top side, said bottom side and said pair of opposing lateral edges;

at least one interwoven fiber grid extending substantially from said back surface to said front surface of said insulative material, and interconnecting said first plurality of fibers to said second plurality of fibers, wherein said insulative material, said at least one interwoven fiber grid and said first and said second plurality of fibers are operatively interconnected.

2. The apparatus of claim 1, wherein said insulative material further comprises a plurality of protuberances extending outwardly from said front surface and said back surface, wherein a space is provided between said first and said second plurality of fibers, respectively, and said front surface and said back surface.

3. The apparatus of claim 1, wherein said insulative material further comprises a plurality of ridges extending outwardly from said front surface and said back surface, wherein a space is provided between said first and said second plurality of fibers, respectively, and said front surface and said back surface.

4. The apparatus of claim 1, wherein said insulative material further comprises a plurality of channels extending into said front surface and said back surface, wherein a thickness of said substantially planar insulative material is operatively reduced in predetermined locations.

5. The apparatus of claim 1, wherein said first and said second plurality of fibers are comprised of at least one of a carbon fiber, a fiberglass, an aramid, a woven and a non-woven fiber.

6. The apparatus of claim 1, wherein said at least one fiber grid comprises a plurality of fibers oriented in a transverse pattern with respect to said front surface and said back surface of said insulative material.

7. The apparatus of claim 1, wherein said at least one fiber grid is comprised of at least one of a woven, a knitted, and a non-woven fiber which is at least partially coated with a polymer.

8. The apparatus of claim 7, wherein said polymer is at least one of a thermoset adhesive and a thermoplastic adhesive.

9. The apparatus of claim 1, wherein said substantially planar insulative material is comprised of at least one of an expanded polystyrene, a urethane, a polyolefin, a polyethylene and an ethylene propylene diene monomer.

10. The apparatus of claim 1, wherein said at least one facing material is comprised at least in part of a concrete material.

11. A building panel adapted for use with at least one facing material, comprising:

an insulative material having a front surface and a back surface;

a first plurality of interconnected fibers positioned proximate to said front surface;

a second plurality of interconnected fibers positioned proximate to said back surface;

at least one fiber grid positioned within said insulative material and having at least a portion extending transversely between said front surface and said back surface, and operably interconnecting said first plurality of interconnected fibers to said second plurality of interconnected fibers; and a spacing means in contact with at least one of said front surface and said back surface of said insulative material to provide a separation between said first and said second plurality of fibers and said insulative material.

12. The apparatus of claim 11, wherein said spacing means comprises a plurality of protuberances extending outwardly from said insulative material.

13. The apparatus of claim 11, wherein said spacing means comprises at least one channel positioned in said insulative material, wherein said separation is filled with a cladding layer.

14. The apparatus of claim 12, wherein said spacing means comprises at least one rail extending outwardly from said insulative material.

15. The apparatus of claim 11, wherein said first and said second plurality of interconnected fibers are comprised of at least one of a carbon fiber, a fiberglass, a plastic and a woven fiber coated with a polymer.

16. The apparatus of claim 11, wherein said at least one fiber grid is comprised of a plurality of interwoven carbon fibers.

17. The apparatus of claim 11, wherein said insulative material is comprised of at least one of an expanded polystyrene, a urethane, a polyolefin, a polyethylene and an ethylene propylene diene monomer.

18. The apparatus of claim 11, wherein said insulative material has at least two distinct widths as measured between said front surface and said rear surface.

19. The apparatus of claim 11, further comprising an exterior concrete cladding material positioned adjacent said front surface and an interior concrete cladding material positioned adjacent said back surface.

20. The apparatus of claim 11, wherein said spacing means is integrally molded with said insulative material.

* * * * *